US006540872B1

(12) United States Patent
Dahl

(10) Patent No.: US 6,540,872 B1
(45) **Date of Patent: *Apr. 1, 2003**

(54) PROCESS FOR CHLORINE DIOXIDE BLEACHING USING A CHELATING AGENT WITHOUT AN INTERMEDIATE WASH

(75) Inventor: Mårten Dahl, Sundsvall (SE)

(73) Assignee: Velmet Fibertech Aktiebolag (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/793,509

(22) PCT Filed: Aug. 11, 1995

(86) PCT No.: PCT/SE95/00920

§ 371 (c)(1),
(2), (4) Date: Feb. 27, 1997

(87) PCT Pub. No.: WO96/06976

PCT Pub. Date: Mar. 7, 1996

(30) Foreign Application Priority Data

Aug. 31, 1994 (SE) ..... 9402885

(51) Int. Cl.[7] ..... D21C 9/14; D21C 9/16

(52) U.S. Cl. ..... 162/76; 162/78; 162/88

(58) Field of Search ..... 162/60, 67, 76, 162/78, 88, 89, 87

(56) References Cited

U.S. PATENT DOCUMENTS

| | | | | | |
|---|---|---|---|---|---|
| 3,655,505 | A | * | 4/1972 | Yorston et al. | 162/76 |
| 3,865,685 | A | | 2/1975 | Hebbel et al. | 162/78 |
| 5,091,054 | A | | 2/1992 | Meier et al. | 162/65 |
| 5,310,458 | A | * | 5/1994 | Lungren et al. | 162/78 |
| 5,571,377 | A | * | 11/1996 | Tibbling et al. | 162/78 |

FOREIGN PATENT DOCUMENTS

| | | |
|---|---|---|
| DE | 2219504 | 2/1994 |
| WO | WO 91/11554 | 8/1991 |
| WO | WO 93/14262 | 7/1993 |
| WO | WO 95/27100 | 10/1995 |

* cited by examiner

*Primary Examiner*—Steve Alvo
(74) *Attorney, Agent, or Firm*—Lerner, David, Littenberg, Krumholz & Mentlik, LLP

(57) ABSTRACT

Methods for bleaching chemical pulps are disclosed including a final bleaching sequence of bleaching with chlorine dioxide, treating with a chelating agent, in which the bleaching and treating steps are carried out in sequence without an intermediate washing step, washing the bleached pulp, and bleaching with hydrogen peroxide.

5 Claims, 1 Drawing Sheet

PROCESS FOR CHLORINE DIOXIDE BLEACHING USING A CHELATING AGENT WITHOUT AN INTERMEDIATE WASH

FIELD OF THE INVENTION

The present invention relates to the bleaching of lignocellulosic material in the form of chemical pulp. More particularly, the present invention relates to the final bleaching of the pulp by using chlorine dioxide and hydrogen peroxide as bleaching chemicals.

BACKGROUND OF THE INVENTION

In order to be able to carry out peroxide bleaching effectively, the pulp must be substantially free of metal ions, especially manganese ions. The metal ions are normally dissolved out in the chlorine dioxide step as a consequence of the conditions in this step. The metal ions are then removed in subsequent washing steps, whereafter the pulp can be peroxide bleached. In most cases this is sufficient to bring about a satisfactory ISO-brightness with a reasonable peroxide consumption

SUMMARY OF THE INVENTION

In accordance with the present invention, it has now been found possible, however, to further lower the metal ion content in the pulp, and to therefore reduce the peroxide consumption and/or to increase the ISO-brightness thereof. According to the present invention, this is achieved by treating the pulp with a chelating agent in direct connection with the chlorine dioxide step.

In accordance with the present invention, it has now been discovered that these objects can now be accomplished by the invention of a method for bleaching a chemical pulp comprising a final bleaching sequence including bleaching the chemical pulp with chlorine dioxide, treating the chemical pulp with a chelating agent, the bleaching and treating steps being sequential and not including an intermediate washing step so as to produce a preliminarily bleached chemical pulp, washing the preliminarily bleached chemical pulp so as to produce a washed chemical pulp, and bleaching the washed chemical pulp with hydrogen peroxide.

In accordance with one embodiment of the method of the present invention, the treating step is carried out immediately prior to the bleaching step.

In accordance with another embodiment of the method of the present invention, the bleaching step is carried out immediately prior to the treating step.

In accordance with another embodiment of the method of the present step, the treating step is carried out for a period of between about 10 and 120 minutes in order to eliminate metal ions therefrom. Preferably, the metal ions are manganese ions.

BRIEF DESCRIPTION OF THE DRAWINGS

The present invention is described in greater detail in the following detailed description with reference to the figures showing two embodiments of the invention, in which.

DETAILED DESCRIPTION

The bleaching process implies that bleaching is carried out in several steps while the final bleaching is carried out with chlorine dioxide and peroxide in separate steps.

Figure 1:
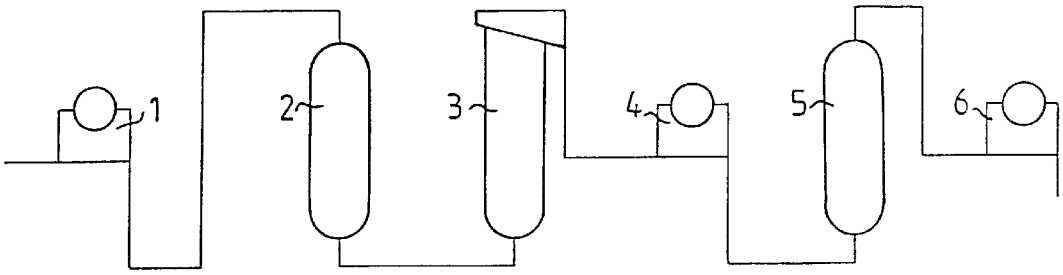
FIG. 1 is a flow diagram of a process according to the present invention.
Figure 2:
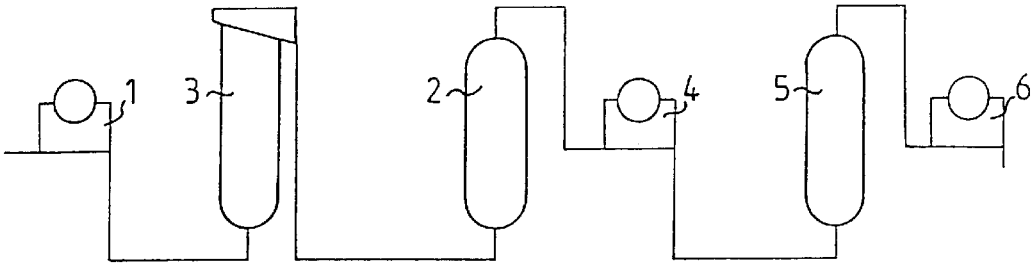
FIG. 2 is another flow diagram of a process according to the present invention.

In the embodiment according to FIG. 1, after a preceding washing step 1, the pulp is first treated with a chelating agent (Q-step) 2 and thereafter with chlorine dioxide (D-step) 3, during which steps these chemicals are charged sequentially. After the D-step 3 the pulp is washed in a washing step 4 and bleached with hydrogen peroxide (P-step) 5 and again washed in a washing step 6. According to the alternative embodiment of the present invention shown in FIG. 2, the chlorine dioxide is charged in the D-step sequentially prior to the chelating agent in the Q-step 2. In other respects, this embodiment corresponds to that shown in FIG. 1.

It is, thus, essential in this invention that the charging of chlorine dioxide and chelating agent take place sequentially, i.e., not together, but in direct connection without any washing therebetween. The charging of the chelating agent together with the chlorine dioxide has been found to yield a deteriorated result, while sequential charging has produced the above-mentioned effect. The present invention thus provides an improved bleaching process in that the bleaching chemicals, especially the hydrogen peroxide, can be utilized more effectively.

The conditions in the Q-step as well as in the D-step can be conventional. Thus, for the Q-step a pulp concentration can be utilized of from about 1% to 20%, preferably from about 8% to 15%, a temperature of from about 45° C. to 100° C., preferably from about 70° C. to 90° C., a pH of from about 1.5 to 8, preferably from about 2 to 4, and a time of from about 10 to 120 minutes, preferably from about 10 to 60 minutes. In the D-step, the conditions can include a pulp concentration of from about 1% to 20%, a temperature of from about 45° C. to 70° C., a pH of from abut 1.5 to 4, and a time of from about 15 to 60 minutes. The subsequent P-step can also be carried out in a conventional manner, with or without the addition of oxygen gas. The peroxide charge, however, as stated above, can be reduced, or alternatively the ISO-brightness be increased, as a result of the process according to the invention. The invention thus provides a more effective utilization of the peroxide.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method for bleaching a chemical pulp comprising a final bleaching sequence including bleaching said chemical pulp with chlorine dioxide, treating said chemical pulp with a chelating agent, said bleaching and treating steps being sequential and not including an intermediate washing step so as to produce a preliminarily bleached chemical pulp, washing said preliminarily bleached chemical pulp so as to produce a washed chemical pulp, and bleaching said washed chemical pulp with hydrogen peroxide.

2. The method of claim 1 wherein said treating step is carried out immediately prior to said chlorine dioxide bleaching step.

3. The method of claim 1 wherein said bleaching step is carried out immediately prior to said chlorine dioxide treating step.

4. The method of claim 1 wherein said treating step is carried out for a period of between about 10 and 120 minutes in order to eliminate metal ions therefrom.

5. The method of claim 4 wherein said metal ions comprise manganese.

* * * * *

UNITED STATES PATENT AND TRADEMARK OFFICE

CERTIFICATE OF CORRECTION

PATENT NO. : 6,540,872 B1
DATED : April 1, 2003
INVENTOR(S) : Marten Dahl

It is certified that error appears in the above-identified patent and that said Letters Patent is hereby corrected as shown below:

Title page,
Item [86], "27" should read -- 25 --.

Column 2,
Line 59, insert -- chlorine dioxide -- before "bleaching".

Signed and Sealed this

First Day of July, 2003

JAMES E. ROGAN
*Director of the United States Patent and Trademark Office*